US006502418B2

(12) United States Patent
Holley, Jr.

(10) Patent No.: US 6,502,418 B2
(45) Date of Patent: Jan. 7, 2003

(54) SPILL-RESISTANT CONTAINER WITH REINFORCED COLD PLUG

(75) Inventor: James W. Holley, Jr., Colorado Springs, CA (US)

(73) Assignee: Insta-mix, Inc. Subsidiary A, Colorado Springs, CA (US)

( * ) Notice: Subject to any disclaimer, the term of this patent is extended or adjusted under 35 U.S.C. 154(b) by 0 days.

(21) Appl. No.: 09/782,986

(22) Filed: Feb. 13, 2001

(65) Prior Publication Data

US 2002/0108394 A1 Aug. 15, 2002

(51) Int. Cl.[7] ..... F25D 3/08
(52) U.S. Cl. ..... 62/457.3; 62/530
(58) Field of Search ..... 62/457.1, 457.2, 62/457.3, 457.4, 371, 372, 530

(56) References Cited

U.S. PATENT DOCUMENTS 2,075,137 A * 3/1937 Rosen ..... 62/457.3
2,187,558 A * 1/1940 Kushima ..... 62/457.3
4,981,022 A * 1/1991 Snyder ..... 62/457.3
5,044,173 A * 9/1991 Cheng ..... 62/372
5,090,213 A * 2/1992 Glassman ..... 62/457.3
5,271,244 A * 12/1993 Staggs ..... 62/457.3
5,284,028 A * 2/1994 Stuhmer ..... 62/457.3
5,597,087 A * 1/1997 Vinarsky ..... 220/482
5,875,646 A * 3/1999 Rich ..... 62/457.3
6,123,065 A * 9/2000 Teglbjarg ..... 126/263.09

* cited by examiner

*Primary Examiner*—William C. Doerrler
(74) *Attorney, Agent, or Firm*—Bever, Hoffman & Harms, LLP; Patrick T. Bever

(57) ABSTRACT

A sippy cup or other spill-resistant container including a cold plug for cooling liquids placed therein. The sippy cup includes a cup body that surrounds a beverage storage chamber. A bottom wall of the cup body defines an opening. In one embodiment, a support flange extends upward from the bottom wall into the fluid storage chamber and surrounds the opening. In another embodiment, a support flange extends upward through the opening into the fluid storage chamber from a sleeved cap. The cold plug structure includes a tube-shaped body enclosing a refrigerant and having a closed end that extends through the central opening into the fluid storage chamber. A base of the cold plug structure is secured to the bottom wall of the cup body, and is supported by the support flange to prevent displacement of the cold plug caused by dropping or otherwise jarring the sippy cup.

9 Claims, 2 Drawing Sheets

SPILL-RESISTANT CONTAINER WITH REINFORCED COLD PLUG

FIELD OF THE INVENTION

The present invention relates to spill-resistant beverage containers, and more particularly to spill-resistant containers incorporating cold plugs.

RELATED ART

Spill-resistant containers are widely used for storing liquids in situations where the liquid may spill from an open-top cup. For example, travel mugs have lids or caps that resist accidental spillage of liquid that slosh due to rough road conditions. A drinking hole is provided in the lids or caps through which liquids (e.g., coffee) may be sipped by a person traveling in an automobile, and an air inlet hole is provided that admits air to replace the volume of fluid sipped from the travel mug. Sports bottles are another type of spill-resistant container that typically includes a screw-on lid having a built-in straw, and a cap for sealing the end of the straw. Some of these sports bottles also have a manually operated pop-up air intake vent that admits air to replace the volume of fluid drawn through the straw.

Sippy cups are a third type of spill-resistant container typically made for children. Sippy-cups include a cup body and a screw-on or snap-on lid having a drinking spout molded thereon. A rubber or spring-loaded self-sealing outlet valve is provided in some sippy cups to control the flow of fluid through the drinking spout. The lid often includes an air inlet port (vent) formed to admit air into the cup body to replace the volume of fluid sipped or sucked through the drinking spout, and a rubber or spring-loaded self-sealing air inlet control valve is sometimes provided to prevent spillage through the air inlet.

A deficiency with conventional spill-resistant containers is that the plastic wall forming the cup is a poor insulator. Accordingly, cool liquid beverages placed in conventional spill-resistant containers become warm over a short period of time, thereby making the beverage less desirable and increasing the possible growth of bacteria.

U.S. Pat. No. 4,981,022, entitled "Refrigerated Bicycle Beverage Carrier", discloses a spill-resistant beverage container including a plastic flask having a mouth for dispensation of a beverage at one end and a central axial opening at the opposite end. To maintain beverages inserted therein at low temperatures, an elongated hollow core (cold plug) is inserted into the central axial opening of the flask. The core has a blind end located within the flask and an access end adapted to receive refrigerant at the central axial opening. The core is filled with a refrigerant, such as a mixture of propylene glycol and water, and is sealed to the flask by ultrasonic welding.

A problem with the spill-resistant beverage container disclosed in U.S. Pat. No. 4,981,022 is that the elongated hollow core is subjected to high shearing forces when the container is dropped or otherwise jarred. These shearing forces can cause cracks at the access end of the hollow core that can lead to leakage of the refrigerant into the flask, thereby contaminating the beverage stored therein.

The potential leakage problem associated with the refrigerated beverage container of U.S. Pat. No. 4,981,022 is particularly important when the hollow core is incorporated into a children's sippy cups described above. In particular, such children's products must pass rigorous safety tests, including drop/shock testing, before being approved for use.

What is needed is a spill-resistant beverage container including a cold plug that reduces the possibility of refrigerant leakage associated with the prior art. In particular, what is needed is a spill-resistant beverage container including a cold plug that is able to pass the rigorous safety tests applied to children's products.

SUMMARY

The present invention is directed to a spill resistant container (e.g., a sippy cup, travel mug, or sports bottle) including a refrigerant cold plug supported by a flange that is secured to or integrally formed on a body of the container. The support flange reinforces a base of the cold plug such that lateral movement of the cold plug is resisted by the flange. By reinforcing the cold plug in this manner, the cold plug remains securely attached to the container body during rigorous safety testing, thereby allowing the spill resistant container to resist refrigerant leakage.

In accordance with a first disclosed embodiment, a spill resistant container includes a cup-shaped body having a bottom wall, which defines a central opening, and a support flange integrally molded to bottom wall such that the support flange surrounds the central opening and extends upward from the bottom wall into the beverage storage chamber defined by the cup-shaped body. A cold plug structure includes a tube-shaped body enclosing a refrigerant and having a closed end that extends through the central opening into the beverage storage chamber. A base of the cold plug structure is secured to the bottom wall of the cup body, and a cap is secured over an open end of the tube-shaped body to seal the refrigerant therein. The support flange provides a rigid support for the tube-shaped body that resists displacement of the cold plug caused by dropping or otherwise jarring the container, thereby preventing cracks that can cause leakage of the refrigerant into the beverage storage chamber.

In accordance with a second disclosed embodiment, a spill resistant container includes a cup-shaped body having a bottom wall defining a central opening, a cap structure including a support flange that extends through the central opening when the lower cap is mounted on the bottom wall of the cup-shaped body, and a cold plug structure mounted in the beverage storage chamber over the support flange and secured to the bottom wall. The cold plug structure includes a tube-shaped body enclosing a refrigerant and having a closed end that extends into the beverage storage chamber. A base of the cold plug structure is secured to the bottom wall of the cup body such that the cap structure seals the refrigerant therein. As in the first embodiment, the support flange provides a rigid support that resists displacement of the cold plug, thereby preventing cracks that can cause leakage of the refrigerant. However, the second embodiment replaces the integral support flange of the first embodiment, which can be difficult to produce using standard molding techniques, with the cap structure that is relatively easy to produce and assemble.

The present invention will be more fully understood in view of the following description and drawings.

DETAILED DESCRIPTION

Figure 1:
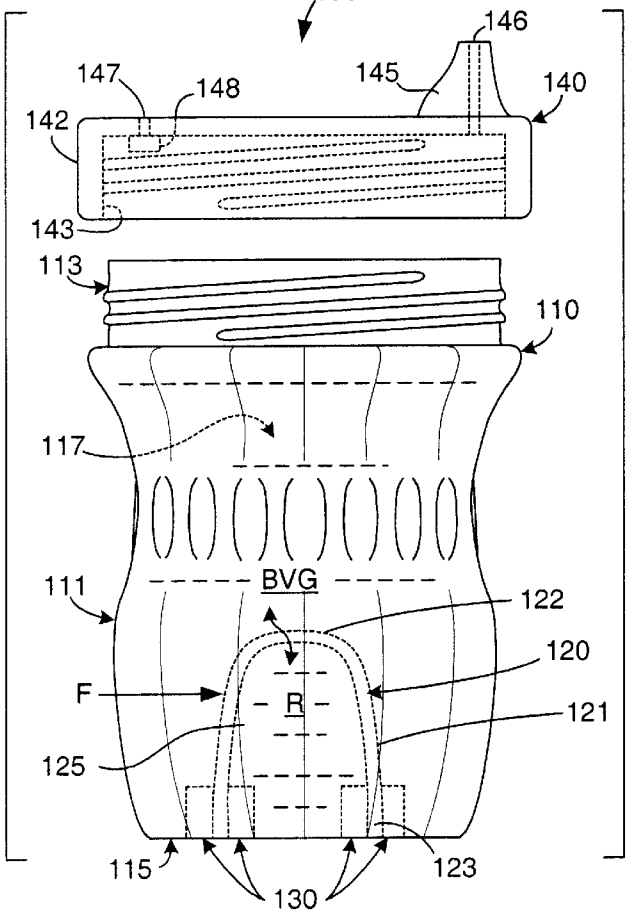
FIG. 1 is a side view showing a sippy cup according to an embodiment of the present invention.

FIG. 1 is a side view showing a sippy cup 100 according to the present invention. Sippy cup 100 includes a hollow cup-shaped body 110 including a cold plug 120 located therein, a support flange 130 for securing a base portion of the cold plug to cup-shaped body 110, and a cap assembly 140.

Body 110 includes a roughly cylindrical sidewall 111 having a threaded upper edge 113, and a bottom wall 115 located at a lower edge of sidewall 111. Sidewall 111 and bottom wall 115 define a beverage storage chamber 117 in which cold plug 120 is located for cooling a beverage BVG placed therein. Body 110 has a height of approximately 4 inches and a diameter of approximately 3 inches.

Cold plug 120 is an elongated capsule for storing a refrigerant R (e.g., a super absorbent polymer and water). Cold plug 120 includes a wall 121 having a closed end 122 and a relatively wide base 123 that define a refrigerant chamber 125 in which refrigerant R is placed. Wall 121 has an average diameter of approximately one inch, and has a length in the range of one to three inches, thereby forming refrigerant chamber 125 with sufficient volume to store approximately one-half to one ounce of refrigerant R. Refrigerant R may take the form of cubic or spherical capsules of plastic filled with a material that absorbs a greater quantity of heat when changing from a solid to a liquid state than does plain water. One such substance is a mixture of 10% propylene glycol and 90% water. It is preferable that refrigerant R be classified as a food grade refrigerant, is non-toxic, and is approved by the U.S. Food and Drug Administration. Suitable refrigerant materials are currently available from Cold Ice, Inc., of Oakland, Calif. Refrigerant R is chilled, for example, by placing body 110 in a refrigerator/freezer prior to use. Once chilled, refrigerant R cools beverage BVG placed in storage chamber 117 by heat exchange through wall 121 (indicated by wavy-lined arrow).

Support flange 130 is rigidly secured both to bottom wall 115 of body 110, and to base 123 of cold plug 120, and extends into storage chamber 117. Support flange 130 has a shape (e.g., cylindrical) that matches a cross-section of base 123 such that support flange 130 contacts the entire periphery of cold plug 120. Support flange 130 extends upward from bottom wall 115 along the inside surface of cold plug 120, the outside surface of cold plug 120, or both. The height (length) and thickness of support flange 130 is selected to maximize resistance to shearing forces F that are applied to cold plug 120, while minimizing the amount of space occupied by support flange 130 within storage chamber 117.

Cap assembly 140 includes a base portion 142 having threaded inside surface 143 that mates with threaded upper edge 113 to connect cap assembly 140 to body 110, thereby enclosing storage chamber 117. Cap assembly 140 also includes a drinking spout 145 defining a fluid outlet passage 146, an air inlet port (vent) 147, and an optional filter 148. When cap assembly 140 is connected to body 110, fluid can be drawn out of storage chamber 117 through fluid outlet port 146 by sucking on drinking spout 145. Air is introduced through air inlet port 147 to equalize pressure in storage chamber 117 as the fluid volume changes. Optional filter 148 prevents the introduction of contaminants into storage chamber 117 during pressure equalization.

Figure 2:
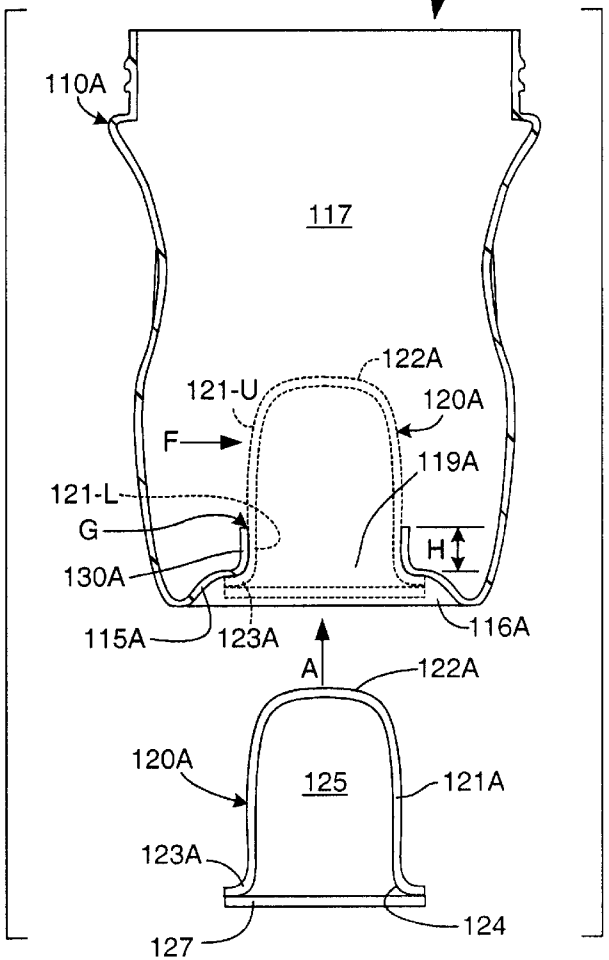
FIG. 2 is an exploded cross-section side view showing a sippy cup in accordance with a first specific embodiment of the present invention.

FIG. 2 is a cross sectional view showing body 110A and a cold plug 120A of a sippy cup 100A according to a first specific embodiment of the present invention. Cap assembly 140 is omitted for clarity. Elements of sippy cup 100A that are related to corresponding elements of sippy cup 100 (FIG. 1) are identified with like reference numbers. Elements including one or more features that are specific to the first embodiment are identified with reference numerals including the letter "A".

Referring to the lower portion of FIG. 2, body 110A is molded from a suitable plastic using known methods such that bottom wall 115A extends radially inward from the lower edge of side wall 111 and forms a slight indentation 116A. Indentation 116A allows cold plug 120A to extend below lower surface 115A without contacting a surface (not shown) upon which sippy cup 100A is placed, thereby allowing sippy cup 100A to stand upright.

In accordance with the first specific embodiment, bottom wall 115A of body 110A defines a circular central opening 119A, and a support flange 130A is integrally formed with bottom wall 115A and extends upward from into beverage storage chamber 117 around opening 119A. The phrase "integrally formed" is used herein to mean that support flange 130A and bottom wall 115A are formed from a continuous piece of plastic during the molding process used to form body 110A, thereby maximizing the structural connection between bottom wall 115A and support flange 130A. In alternative embodiment, support flange 130A may be secured to bottom wall 115A using an adhesive or ultrasonically welding process after body 110A is molded. In either case, flange 130A forms a cylindrical wall that surrounds opening 119A and has a height H in the range of one-quarter to one-half inch (or more) above bottom wall 115A. As described in additional detail below, the height H is selected to provide suitable support for cold plug 120A.

In accordance with another aspect of the first embodiment, cold plug 120A includes an end cap 127 that is, for example, ultrasonically welded to base 123A to seal the refrigerant in refrigerant chamber 125. Cold plug 120A is then inserted (as indicated by the arrow A in FIG. 2) through opening 119A such that closed end 122 and an upper portion 121-U of wall 121A extend into beverage storage chamber 117. Base 123A is then ultrasonically welded to bottom wall 115A of body 110A.

When cold plug 120A mounted onto body 110A in the manner indicated by dashed lines in FIG. 2, cylindrical lower portion 121-L of wall 121A contacts and is supported by support flange 130A. By supporting lower portion 121-L in this manner, lateral forces F (indicated by arrow) that are transferred to cold plug 120A are resisted, thereby preventing cracking and possible leakage of refrigerant from cold plug 120A.

In accordance with yet another aspect of the first embodiment, when cold plug 120A is mounted onto body 110A in the manner indicated in FIG. 2, contact between cylindrical lower portion 121-L and support flange 130A provides additional protection against leakage of refrigerant into storage chamber 117. Specifically, if base 123A of cold plug 120A is damaged, refrigerant is prevented from leaking into storage chamber 117 by (a) the ultrasonic weld securing base 123A to bottom wall 115A of body 110A, and (b) the additional seal provided by the contact between lower portion 121-L and support flange 130A.

Figure 3:
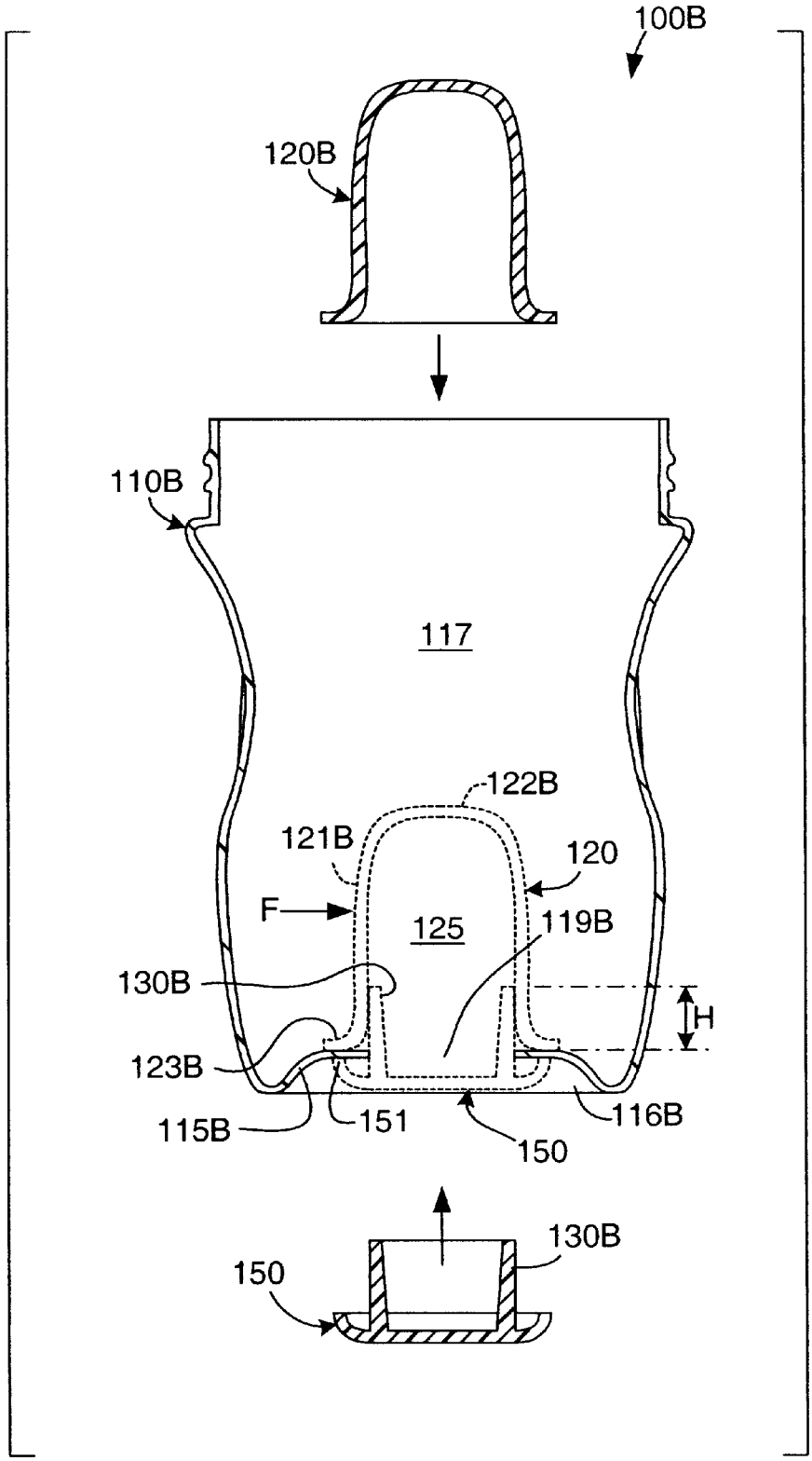
FIG. 3 is an exploded cross-section side view showing a sippy cup in accordance with a second specific embodiment of the present invention.

FIG. 3 is a cross sectional view showing a sippy cup 100B according to a second specific embodiment of the present invention. Sippy cup 100B includes a cup-shaped body 110B, a cold plug 120B, and a sleeved cap 150 that includes a support flange 130B formed thereon. Elements of sippy cup 100B that are related to corresponding elements of sippy cup 100 (FIG. 1) and sippy cup 100A (FIG. 2) are identified with like reference numbers. Elements including one or more features that are specific to the second embodiment are identified with reference numerals including the letter "B".

Referring to the lower portion of FIG. 3, body 100B is molded from a suitable plastic using known methods such that bottom wall 115B extends radially inward from the lower edge of side wall 111 and forms a slight indentation 116B. Indentation 116B allows a lower portion of sleeved cap 150 to extend below lower surface 115B without contacting a surface (not shown) upon which sippy cup 100B is placed, thereby allowing sippy cup 100B to stand upright on a flat level surface.

In accordance with the second specific embodiment, support flange 130B is integrally formed on sleeved cap 150 such that, when plug assembly 150 is mounted onto body 110B (as indicated by dashed lines in FIG. 3), support flange 130B extends upward into storage chamber 117 through an opening 119B, which is formed in lower wall 115B of body 110B. A peripheral edge 151 of sleeved cap 150 is ultrasonically welded or otherwise secured to a lower surface of bottom wall 115B. When thus secured, support flange 130B forms a cylindrical wall that extends a height H, which is one-quarter of an inch or more (e.g., approximately one-third of an inch), above bottom wall 115B.

In accordance with another aspect of the second embodiment, cold plug 120B includes a tub-shaped wall 121B having a closed end 122B, and a base 123B defining an open end. Cold plug 120B is inserted through the upper opening of body 110B (as indicated by the arrow in FIG. 3), and secured to an upper surface of bottom wall 115B, e.g., by ultrasonic welding. Note that, unlike the first embodiment (described above), cold plug 120B is mounted over support flange 130B such that support flange 130B is inserted into and contacts the inner peripheral surface of wall 121B surrounding base 123B.

When cold plug 120B mounted onto body 110B in the manner indicated by dashed lines in FIG. 3, a lower portion of wall 121B contacts and is supported by support flange 130B, which is inserted therein. By supporting the lower portion in this manner, lateral forces F (indicated by arrow) that are transferred to cold plug 120A are resisted, thereby preventing cracking and possible leakage of refrigerant from cold plug 120B.

Sippy cup 100B avoids several potential problems that may arise with the first embodiment (described above).

First, by inserting support flange 130B into cold plug 120B in the manner shown in FIG. 3, the resulting structure reduces the occurrence of gaps or cracks that can trap bacteria-forming beverage residue. Referring briefly to FIG. 2, sippy cup 100A has a potential problem in that gaps G can be formed between lower portion 121-L and support flange 130A. These gaps can be avoided by, e.g., ultrasonically welding these pieces together, but such a process would increase manufacturing costs. Returning to FIG. 3, sippy cup 100B avoids this problem using a single weld between base 123B and lower wall 115B.

Second, by utilizing sleeved cap 150 to provide support flange 130B, sippy cup 100B avoids potentially costly and complicated manufacturing processes needed to form support flange 130A of sippy cup 100A (described above). Referring briefly to FIG. 2, the formation of support flange 130A using current low-cost molding processes and equipment is very difficult, thereby increasing manufacturing costs. Returning to FIG. 3, sippy cup 100B avoids this problem by providing lower opening 119B in bottom wall 115B, which is relatively easy to manufacture, and using sleeved cap 150 to provide support flange 130B.

In addition to the specific embodiment disclosed herein, the present invention may be incorporated into other spill-resistant containers such as travel mugs and sport bottles. Other features and aspects may be added to these spill-resistant containers that fall within the spirit and scope of the present invention. Therefore, the invention is limited only by the following claims.

What is claimed is:

1. A container comprising:

a body including a side wall surrounding a storage chamber, the side wall having an lower edge, the body also including a bottom wall extending radially inward from the lower edge of the side wall, the bottom wall defining an opening;

a tube-shaped cold plug including a base that is fixedly attached to an inside surface of the bottom wall of the body over the opening, wherein an inner peripheral surface of the cold plug defines a refrigerant chamber, and an outer surface of the cold plug extends into the storage chamber; and a cap fixedly connected to an outside surface of the bottom wall of the body and including a support flange extending through the opening and contacting the inner peripheral surface of the cold plug.

2. The container according to claim 1, wherein the base of the cold plug is ultrasonically welded to the bottom wall of the body.

3. The container according to claim 1, wherein the cap includes a peripheral edge that is ultrasonically welded to the bottom wall of the body.

4. The container according to claim 1, wherein the support flange extends at least one-quarter inch above the bottom wall into the cold-plug.

5. The container according to claim 1, wherein the body comprises a cup having a threaded upper edge, and wherein the container further comprises a spill-resistant cap including a threaded inside surface for connecting the spill-resistant cap to the threaded upper edge of the cup.

6. The container according to claim 5, wherein the spill-resistant cap further comprises a drinking spout extending from an upper surface, wherein the drinking spout surrounds a fluid outlet port.

7. The container according to claim 6, further comprising a resilient valve connected to a lower portion of the drinking spout.

8. The container according to claim 1, wherein the container is a travel mug.

9. The container according to claim 1, wherein the container is a sports bottle.

* * * * *